United States Patent [19]

Hafner et al.

[11] Patent Number: 4,857,003

[45] Date of Patent: Aug. 15, 1989

[54] APPARATUS FOR ELECTRICAL CONNECTION OF ELECTROMAGNETICALLY ACTUATABLE FUEL INJECTION VALVES

[75] Inventors: Udo Hafner, Lorch; Ferdinand Reiter, Markgroningen, both of Fed. Rep. of Germany

[73] Assignee: Robert Bosch GmbH, Stuttgart, Fed. Rep. of Germany

[21] Appl. No.: 134,128

[22] Filed: Dec. 17, 1987

[30] Foreign Application Priority Data

Feb. 6, 1987 [DE] Fed. Rep. of Germany ..... 3703592
Aug. 5, 1987 [DE] Fed. Rep. of Germany ..... 3725980

[51] Int. Cl.[4] ..... F01L 1/34; F02M 53/04

[52] U.S. Cl. ..... 439/130; 123/90.16; 439/505

[58] Field of Search ..... 123/472; 439/34, 130, 439/211, 214, 215, 216, 505, 499

[56] References Cited

U.S. PATENT DOCUMENTS

| | | | |
|---|---|---|---|
| 3,951,508 | 4/1976 | Farrer et al. | 439/130 |
| 4,235,452 | 10/1981 | Lembke et al. | 123/470 |
| 4,453,671 | 6/1984 | Hafner | 239/124 |
| 4,463,727 | 7/1984 | Babitzka et al. | 123/458 |
| 4,466,390 | 7/1984 | Babitzka et al. | 123/90.16 |

*Primary Examiner*—William L. Sikes
*Assistant Examiner*—Akm E. Ullah
*Attorney, Agent, or Firm*—Edwin E. Greigg

[57] ABSTRACT

An apparatus for effecting electrical connection of fuel injection valves for fuel injection systems of internal combustion engines connected to an electronic control unit simultaneously onto each of the individual fuel injection valves. The individual plugs of the apparatus associated with each fuel injection valve are disposed on a common connection strip which can be fastened to the engine by means of threaded bolts and can be connected to the electronic control unit by means of a cable harness.

25 Claims, 6 Drawing Sheets

APPARATUS FOR ELECTRICAL CONNECTION OF ELECTROMAGNETICALLY ACTUATABLE FUEL INJECTION VALVES

BACKGROUND OF THE INVENTION

The invention relates to an apparatus for electrical connection of electromagnetically actuatable fuel injection valves. Fuel injection valves are already known in which the electrical connection is effected by means of individual plugs, which are inserted in succession into each associated fuel injection valve. This is a highly labor-intensive part of mounting the fuel injection valves on the engine, since the fuel injection valves must first be plugged into the individual openings provided for them on the individual intake tubes of the engine, and then the axial fixation of the fuel injection valves in these openings is done by means of individual clamping claws. After that, the plug that is electrically conductively connected to the electronic control unit is plugged onto each fuel injection valve.

OBJECT AND SUMMARY OF THE INVENTION

The apparatus according to the invention has the advantage over the prior art that the electrical connection of a plurality of fuel injection valves is effected all at the same time in one operation by means of the plugs disposed on a connection strip, and at the same time a force in the axial direction can be exerted upon the fuel injection valves, by means of which they are fixed in the axial direction. The fuel injection valves can also be plugged onto the plugs of the connection strip and them, by means of the connection strip, introduced all together into the openings of the individual intake tubes or cylinders at the cylinder head of the engine.

It is advantageous for the plugs to be embodied in the form of first and second plug parts and for the plug parts to be joined together in such a way that one of the plug parts extends through a plug opening of the connection strip and the connection strip is held in place between the two plug parts.

In another advantageous feature of the invention, the plugs are embodied on the connection strip, which is made of plastic.

It is also advantageous for a connection plug that is connected to the second electrically conductive contact elements of the plugs to be disposed on the connection strip.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
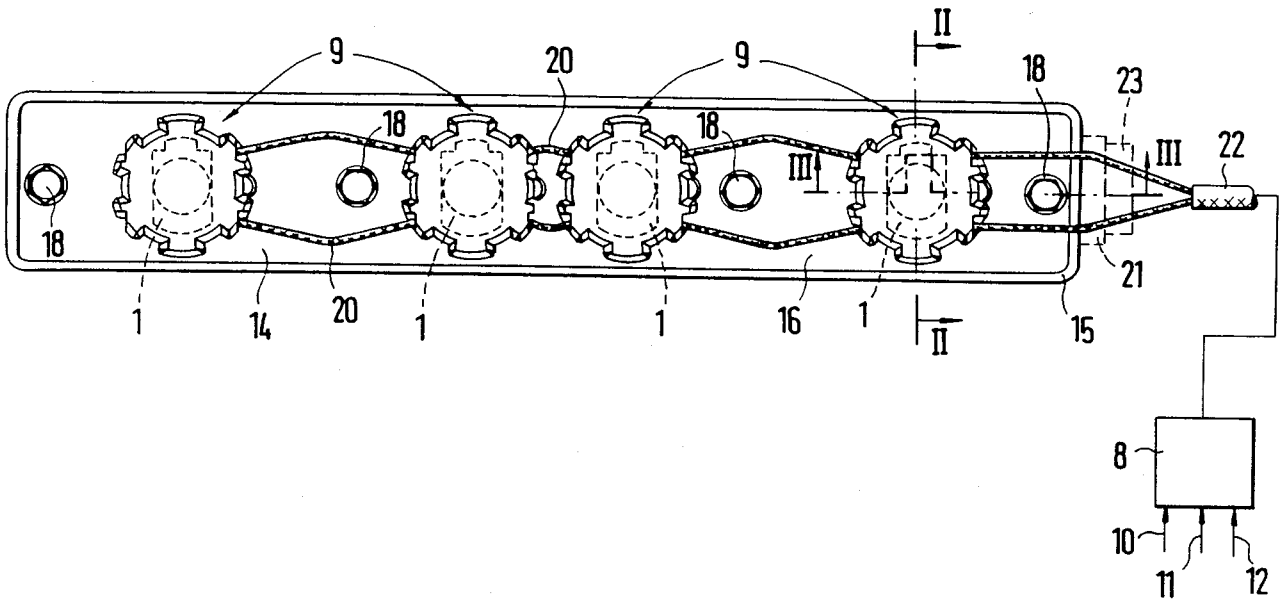
FIG. 1 shows a first exemplary embodiment of a connection strip embodied according to the invention, seen in plan view.
Figure 2:
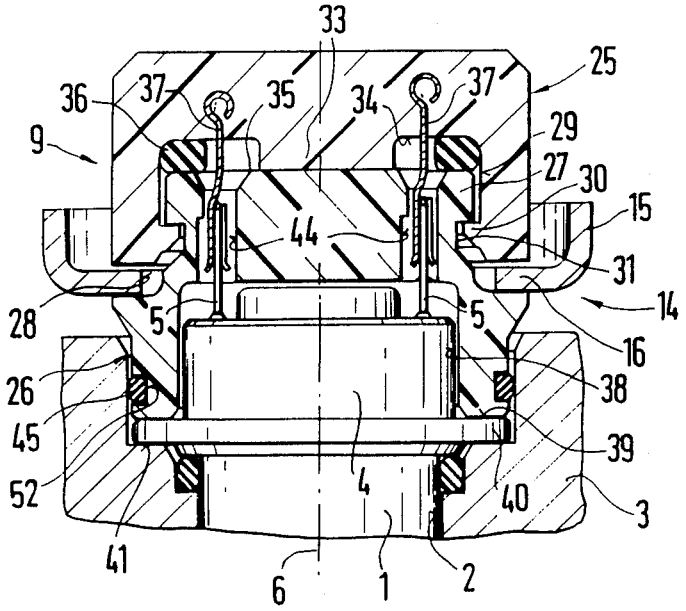
FIG. 2 is a section taken along the line II—II of FIG. 1.
Figure 3:
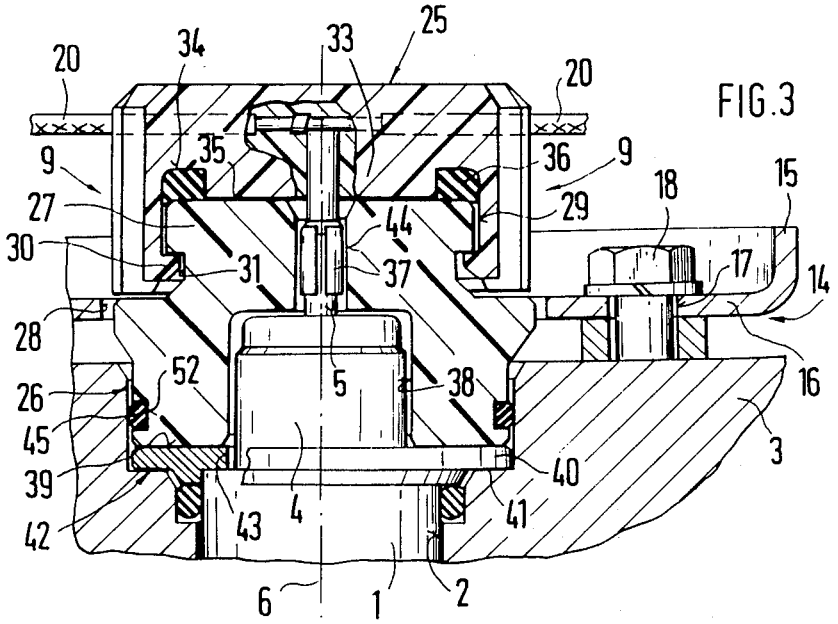
FIG. 3 is a section taken along the line III—III of FIG. 1.

In the first exemplary embodiment of an apparatus for electrical connection of electromagnetically actuatable fuel injection valves 1 shown in FIGS. 1–3, four fuel injection valves 1 are inserted into stepped receiving openings 2 of individual intake tubes, or on cylinders 3, directly before the inlet valves of mixture-compressing internal combustion engines having externally supplied ignition. Remote from the injection end, not shown, of the fuel injection valve 1, the fuel injection valve has a head end 4, from which contact pins 5, protrude as a rule two in number, embodied as first electrically conductive contact elements. The contact pins 5 extend approximately in the direction of the longitudinal axis 6 of the fuel injection valve 1 and are electrically conductively connected to a magnet coil, not shown. The contact pins 5 preferably have a rectangular cross section. The electrical connection of each individual fuel injection valve to an electronic control unit 8 is effected via plugs 9, one of which is associated with each fuel injection valve 1. The fuel injection valves 1 and the control unit 8 are components of a fuel injection system, in which the quantity of fuel injected via the fuel injection valves 1 is metered as a function of engine operating characteristics supplied to the control unit 8, such as aspirated air quantity 10, load 11, temperature 12 and others. According to the invention, the plugs 9 are disposed on a common connection strip 14, which may be embodied as quite flat, or as in the drawings may for example be tub-like in shape, and may be made of sheet metal. If the connection strip 14 is tub-like in shape, a rim region 15 on the circumference of the entire connection strip is bent at approximately a right angle with respect to a flat inner region 16. This bent rim region 15 may also extend over only a portion of the circumference of the connection strip, for instance over only one or two rim regions on the narrow ends of the connection strip, or over one or both rim regions on the long sides of the connection strip 14. The connection strip may be made of metal, plastic or ceramic and has fastening holes 17, through which threaded bolts 18 can be inserted and threaded into the wall of the engine in order to secure the connection strip to the engine. The connection strip 14 shown has an elongated straight shape; however, it could also have a shape that is curved in the longitudinal direction, in the event that the fuel injection valves are not disposed in a line, one behind the other. The connection strip 14 shown has four plugs, spaced apart from one another in the axial direction of the connection strip, for four individual fuel injection valves 1. Leading to the individual plugs 9 are electric lines 20, which either originate at a connection plug 21, is shown in broken lines and disposed on the connection strip, or lead to a cable harness 22, which is connected to the electronic control unit 8 either directly or via a plug connection, not shown. Via the connection plug 21, a plug connection can also be made with a complementary plug 23, shown in broken lines, which is connected to the cable harness 22. The axial spacing of the plugs 9 and their location with respect to one another on the connection strip are in agreement with the spacing and location of the fuel injection valves 1 on the engine.

By means of the plugs 9 disposed on the common connection strip 14, simultaneous establishment of a plug connection among all the fuel injection valves 1 and the plugs 9 during assembly is possible. In the present exemplary embodiment, each plug 9 comprises a first plug part 25 and a second plug part 26. The second plug part 26 has a protrusion 27, extending in the direction of the longitudinal axis 6, which extends engagingly through a plug opening 28 in the inner region 16 of the connection strip 14 and protrudes into a receiving opening 29 of the first plug part 25 disposed on the other side of the connection strip 14. Oriented toward the connection strip 14, the first plug 25 has detent lugs 30 protruding into the interior of the receiving opening, which when assembled with the second plug portion 26 lock into place in a detent groove 31 on the extension 27 of the second plug part 26 and thus fix the first plug part 25 and the second plug part 26 axially with respect to one another. Naturally the two plug parts 25, 26 could be fastened to one another in some other way instead; for instance, the detent lugs could be formed on the extension 27 and the detent groove could be formed on the first plug part 25. In this condition, a stop lug 33 of the bottom 34 of the cup-shaped receiving opening 29 is braced against the end face 35 of the extension 27, and a plug sealing ring 36 that surrounds the stop lug is braced between the bottom 34 and the end face 35. The first plug part 25 and the second plug part 26 are advantageously made of plastic and adhere to or clamp between them the connection strip 14, to which end the two plug parts protrude toward the outside beyond the plug opening 28, although optionally there can certainly be play in the axial direction between the plug parts and the connection strip. In the first plug part 25, second electrically conductive contact elements 37 are embedded with one end, while their other ends, located inside the plug sealing ring, protrude into the receiving opening 29 and are aimed at the contact pins 5, which partly encompass them, thereby establishing an electrically conductive connection. Inside the first plug part 25, the second electrically conductive contact elements are each electrically conductively connected with one electric line 20 and at the other end are advantageously embodied as so-called flat plugs. In the assembled state, with an overlap opening 38 that is for instance rectangular, the second plug part 26 overlaps the head end 4, at least part of which likewise has a rectangular cross section, and is braced with its end plug face 39 on a collar 40 of the fuel injection valve 1, which on the other side is pressed in this way against a rim 41 of the stepped receiving bore 2, thereby fixing the fuel injection valve in the axial direction. The collar 40 may also be embodied on an intermediate ring 42, as shown in FIG. 3, that rests on the fuel injection valve 1 and with a central opening 43 encompasses the head end 4. In the state in which the plug 9 is slipped onto the head end 4 of the fuel injection valve 1, the contact pins 5 protrude from one side and the flat plugs 37 protrude from the other side each into a through opening 44, extending from the overlap opening 38 to the end face 35 of the extension 27, and establish an electrically conductive plug connection. The through openings 44 have approximately the same spacing with respect to one another as the contact pins 5. Sealing between the plug 9 and the receiving opening 2 can be effected by a sealing ring 45, which is placed in a circumferential groove 52 of the second plug part 26 and rests with tension against the wall of the receiving opening 2.

Figure 4:
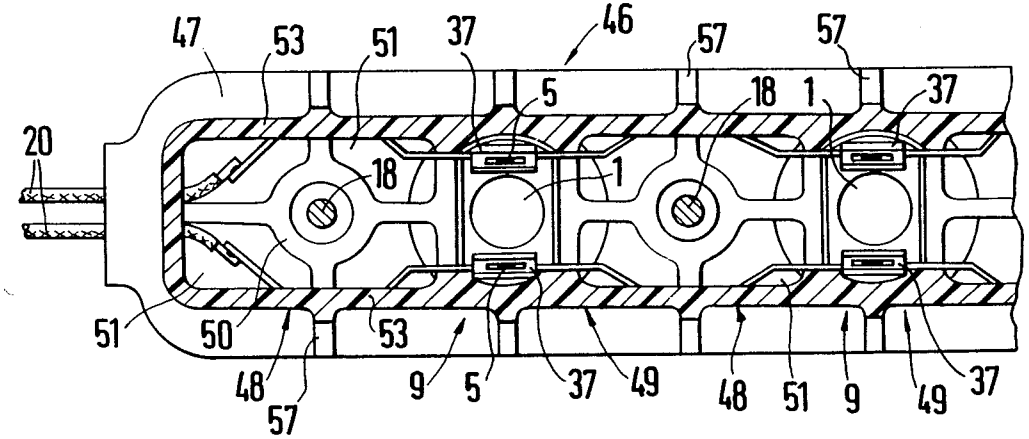
FIG. 4 shows a second exemplary embodiment of a connection strip embodied in accordance with the invention, seen in a sectional plan view.
Figure 5:
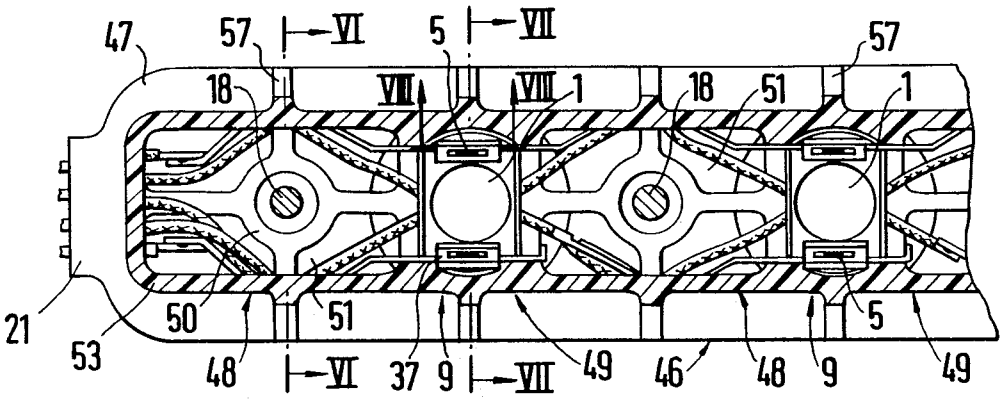
FIG. 5 is a sectional plan view of a third exemplary embodiment of a connection strip embodied in accordance with the invention.

In the second exemplary embodiment of FIG. 4, elements that are the same as those of the first exemplary embodiment of FIGS. 1–3 and function the same are identified by the same reference numerals. In the second examplary embodiment of FIG. 4, the connection strip 46 and the plugs 9 are made in one piece from plastic, for example in the form of an injection molded part. Once again, the connection strip 46 is elongated in shape. As shown for example in FIGS. 6 and 7, various cross sections of the connection strip 46 are possible. As in FIG. 6, the connection strip 46 may have an encompassing flat base plate 47, which in its middle region merges with fastening sections 48 and plug sections 49. The fastning sections 48 and the plug sections 49 each protrude outward from the base plate 47 on the side remote from the fuel injection valves 1. Each fastening section 48 is for instance tub-shaped, with an X-shaped fastening base 50 oriented toward the base plate 47; if the fastening base 50 is embodied in this way, it has sufficient strength yet uses as little material as possible, and the screws 18 for fastening the connection strip 46 can be introduced through the fastening holes 17 of this fastening base 50. The fastening base 50 may have a circular middle region receiving the fastening hole 17, with four legs, for instance, extending in star-like fashion from the middle region toward the base plate 47, thereby forming recesses 51. Each tub-shaped fastening section 48 has side walls 53 leading away from the base plate 47, with slits 54 recessed at least partway into these walls, beginning at the end face 60 of the strip. Through these slits 54, electric lines 20 are guided to the various plugs 9, or to the second electrically conductive contact elements 37 of the plugs 9. The electric lines 20 may be in the form of round wire or strip-like contact rails, for example as shown in cross section in FIGS. 6 and 8. In the exemplary embodiment of FIG. 4, the electric lines 20 are connected such that the individual fuel injection valves are connected electrically parallel, so that all the fuel injection valves electrically connected by means of the connection strip 46 can be excited simultaneously. As already noted in connection with FIG. 1, the electric lines 20 can be extended in the form of individual lines out of the connection strip and then in the form of a cable harness 22 to the electronic control unit 8. Alternatively, as shown in FIG. 5 and as described in connection with FIG. 1, the electric lines 20 can be connected to a connection plug 21 molded onto the connection strip 46. The strip-like contact rails 20 also serving as electric lines can be embodied, in the vicinity of the plugs 9, as second contact elements 37 in the form of flat plugs, by shaping this region of the contact rail in a bending process to form a flat plug, the cross section of which is in the form of a U, with legs that are open toward the contact pins 5 and partly encompass them, keeping them under tension. The contact pin 5 in that case is suitably provided with a rectangular cross section. Remote from the open end of the flat plug 37, the flat plug has a lead-out slot 55, which in the case of a rectangular contact 5 is suitably likewise rectangular and enables leading-out insertion of the contact pin 5; in the longitudinal direction, the lead-out slot 55 is substantially longer than the contact pin 5, to provide enough play in order to equalize tolerances. The electric lines 20 can also be guided in grooves 56 of the base plate 47 (see FIG. 6) that are intended for these lines. Support ribs 57 extending from the base plate 47 to the side walls 53 or to the plug 9 assure sufficient rigidity on the part of the connection strip 46.

Figure 7:
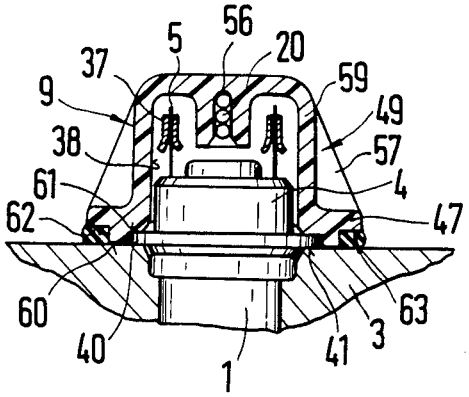
FIG. 7 is a section taken along the line VII—VII of FIG. 6.
Figure 8:
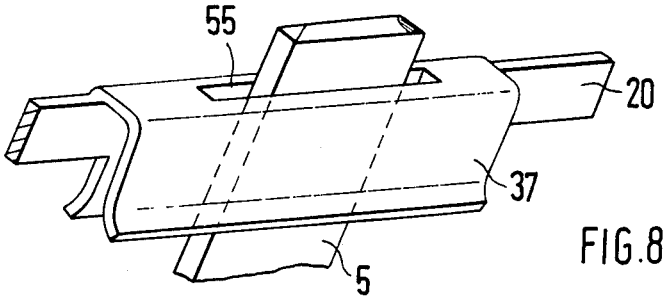
FIG. 8 is a fragmentary view, on a different scale, of the second contact elements.

The fastening sections 48 and the plug sections 49 of the connection strip 46 alternate with one another as needed. In FIG. 7, for instance, a cross section is shown through a plug section 49, which like the side walls 53 rises in cup-like fashion from the base plate 57 and with a bulging portion 59 encompasses the head end 4 of the fuel injection valve 1, which in turn protrudes into the blind-bore-like overlap opening 38 of the bulging portion 59, where with its contact pins 5 it engages the flat plugs 37, which are retained inside the overlap opening 38 in the plugs 9 in a state of connection with the electric lines 20. The electric lines can likewise be guided in the vicinity of the plug sections 49 in slits 54 or line grooves 56 embodied in the walls of the plug section. In the vicinity of the plug sections 49, the side walls 53 of the fastening sections 48 merge with the bulging portion 59. On its strip end face 60 remote from the bulging portion 59, the base plate 47 has an indentation 61, with which the connection strip 46 overlaps the collar 40 and, as described above in connection with the first exemplary embodiment, braces the fuel injection valve 1 in the axial direction in order to fix it. The indentation, like an annular groove 62 embodied on the strip end face 61, is open toward the individual intake tube or cylinder 3. A sealing ring 63 is introduced into the annular groove 62, and when the connection strip 46 has been fastened by means of the screws 18 this sealing ring 63 extends in the bae plate 47 between the connection strip 46 and the individual intake tubes or cylinders 3 in a manner sealed off from the fuel injection valves 1.

Figure 6:
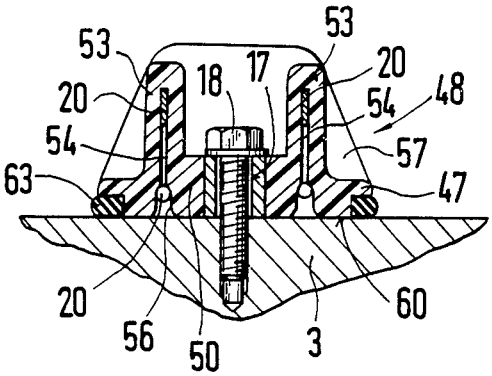
FIG. 6 is a section taken along the line VI—VI of FIG. 5.

The third exemplary embodiment of a connection strip 46 in accordance with the invention uses the same reference numerals for identical and identically functioning elements as were used above for the other embodiments. The connection strip 46, again made in common with the plugs 9 from plastic, and which again has cross sections as shown in FIGS. 6 and 7 in the cross sections of the fastening section 48 and plug section 49, differs from the second embodiment of FIG. 4 solely in the manner of attachment of a connection plug 21 and in terms of how the electric lines 20 are guided. In the third exemplary embodiment of FIG. 5, the electric lines 20 are guided such taht the fuel injection valves 1 electrically connected by means of the connection strip 46 can be excited in succession or in groups by the electronic control unit.

Figure 9:
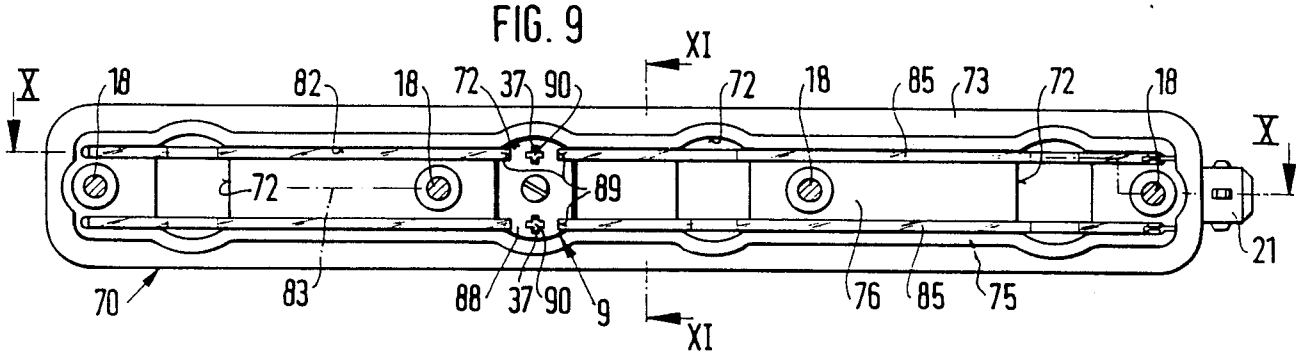
FIG. 9 shows a fourth exemplary embodiment of a connection strip embodied in accordance with the invention.

In the fourth exemplary embodiment of FIGS. 9–12, elements remaining the same as and functioning like those of earlier embodiments are again identified by the same reference numerals. In this exemplary embodiment, the connection strip 70 is made of plastic, for instance in the form of an injection molded part. The connection strip 70 is elongated and has formed-on hoods 71 disposed spaced apart along the strip, each of which forms a housing for one plug 9 and has a blind-bore-like plug opening 72. The hoods 71 protrude outward from a base plate 73 of the connection strip 70. A reinforcement rib 74 etends between the hoods 71 in the longitudinal direction of the connection strip 70. Remote from the hoods 71 and from the reinforcement rib 74, a longitudinal groove 76, which is open toward the strip end face 75 with which the connection strip rests on the engine, extends inside the connection strip 70, intersecting the various plug openings 72 and connecting them with one another. The plug openings 72 are open toward the longitudinal groove 76 and the strip end face. A sealing ring 63 may be disposed in an annular groove 62 of the strip end face 75, braced against a suitable bearing surface of the engine, so that the longitudinal groove 76 is substantially sealed off from the outside. The connection strip 70 is fastened to the engine with threaded bolts 18. To this end, the connection strip has fastening holes 17 spaced apart from one another, into which a centering bushing 78 can be inserted, which protrudes with little play into a centering opening 79 of the engine. The threaded bolt 18 is threaded into an opening 80 of the centering bushing 78 and threaded together with a threaded bore 81 of the engine. In FIG. 9, four threaded bolts 18 are provided on the connection strip, and four plugs 9.

When the connection strip is secured to the engine, the strip end face 75 can serve to engage the collar 40 of each fuel injection valve 1 and to brace each fuel injection valve 1 in the axial direction.

Figure 10:
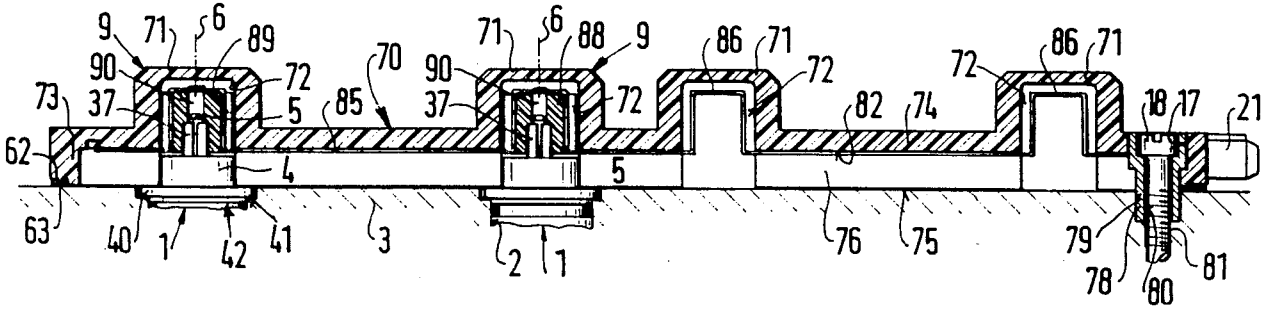
FIG. 10 is a section taken along the line X—X of FIG. 9.
Figure 11:
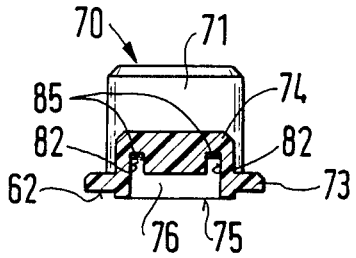
FIG. 11 is a section taken along the line XI—XI of FIG. 9.
Figure 12:
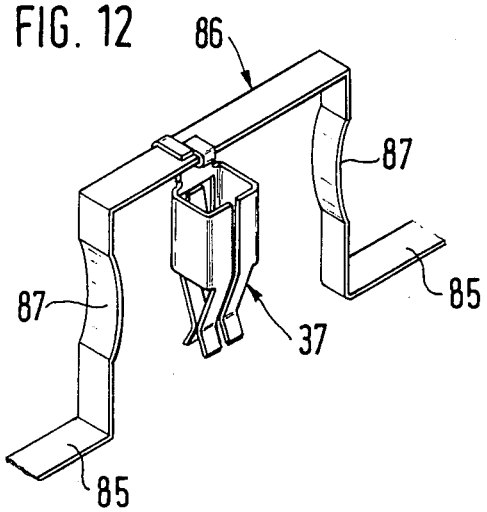
FIG. 12 is a fragmentary view of a strip-like connection rail having a flat plug.

Contact rail grooves 82 are also provided, extending open toward the longitudinal groove 76 and in the longitudinal direction of the connection strip 70; the longitudinal grooves intersect the various plug openings 72 and extend symmetrically with respect to the strip axis 83. Each contact rail grooves 82 serve to receive and guide one strip-like contact rail 85 serving as an electric line. Each contact rail 85 is connected to the electronic control unit via the connection plug 21. As shown in FIG. 10 in the two plug openings 72 on the right and on a different scale in FIG. 12, each contact rail 85 is bent in a meandering pattern out of the plane of its strip, forming individual hoops 86, so that each hoop 86 protrudes into one plug opening 72. Each hoop 86 may be provided with compensating bulges 87, which assure a certain amount of compensation in length. in the vicinity of the plugs 9, each hoop 86 is electrically conductively connected, for instance by welding, clamping or soldering, to a flat plug 37 serving as a second contact element.

One insert body 88 is inserted into each plug opening 72 to form a respective plug 9 and may be connected to one hood 71 by means of a screw or a detent connection. In FIG. 9, only one insert body 88 is shown in the second plug opening 72 from the right, and in FIG. 10 an insert body is shown only in the first and second plug openings 72 from the left. Each insert body 88 has guide grooves 89, which extend approximately parallel to the longitudinal plug axis 6 and each guides one hoop 86 of the contract rails 85. Furthermore, each insert body 88 has retainer openings 90, corresponding in number to the required number of flat plugs 37, which openings penetrate each insert body 88 in the direction of the longitudinal plug axis 6 and serve to retain the flat plugs 37. In the present exemplary embodiment, two retainer openings 90 are provided, each for receiving one flat plug 37, in the insert body 88, so that each contact pin 5 of each fuel injection valve 1 can be put into electrical connection with one of the flat plugs 37.

As already described in connection with the other exemplary embodiments, the connection strip 70 makes it possible to establish a plug connection simultaneously between all the fuel injection valves 1 and the plugs 9.

The foregoing relates to preferred exemplary embodiments of the invention, it being understood that other variants and embodiments thereof are possible within the spirit and scope of the invention, the latter being defined by the appended claims.

What is claimed and desired to be secured by letters patent of the United States is:

1. An apparatus for connecting an electronic control unit to electrical contacts of at least two electromagnetically actuatable fuel injection valves of a fuel injection system for an internal combustion engine which comprises a common connection strip including at least two connection plugs, electrically conductive elements disposed in said plugs, electrically conductive conductors disposed on said connection strip and connected to said electronic control unit and to said electrically conductive elements in said plugs.

2. An apparatus as defined by claim 1, in which said common connection strip (14, 46, 70) includes fastening means to fasten said common connection strip to the engine.

3. An apparatus as defined by claim 1, in which each plug (9) is embodied by a first plug part (25, 71) and a second plug part (26, 88), which are connectable to one another.

4. An apparatus as defined by claim 2, in which each plug (9) is embodied by a first plug part (25, 71) and a second plug part (26, 88), which are connectable to one another.

5. An apparatus as defined by claim 3, in which one of said plug parts (25, 26) has an extension (27) in an axial direction, which protrudes engagingly through a plug opening (28) of said connection strip (14) and protrudes into the other plug part (25, 26).

6. An apparatus as defined by claim 4, in which one of said plug parts (25, 26) has an extension (27) in an axial direction, which protrudes engagingly through a plug opening (28) of said connection strip (14) and protrudes into the other plug part (25, 26).

7. An apparatus as defined by claim 5, in which said connection strip (14) is inserted in between said first and second plug parts (25, 26).

8. An apparatus as defined by claim 6, in which said connection strip (14) is inserted in between said first and second plug parts (25, 26).

9. An apparatus as defined by claim 3, in which said first and second plug parts (25, 26, 71, 88) are connectable with one another by means of a detent connection (30, 31).

10. An apparatus as defined by claim 4, in which said first and second plug part (25, 26, 71, 88) are connectable with one another by means of a detent connection (30, 31).

11. An apparatus as defined by claim 3, in which said second plug part (26) is oriented toward the fuel injection valve (1) and exerts a force upon the fuel injection valve (1) for an axial fixation of the fuel injection valve (1).

12. An apparatus as defined by claim 4, in which said second plug part (26) is oriented toward the fuel injection valve (1) and exerts a force upon the fuel injection valve (1) for an axial fixation of the fuel injection valve (1).

13. An apparatus as defined by claim 1, in which said plugs (9) are embodied on the connection strip (46, 70) made from plastic and said electrically conductive elements (37) are secured in the plugs (9) and connected with electric lines (20, 85) guided in the connection stirp (46, 70).

14. An apparatus as defined by claim 2, in which said plugs (9) are embodied on the connection strip (46, 70) made from plastic and said electrically conductive elements (37) are secured in the plugs (9) and connected with electric lines (20, 85) guided in the connection strip (46, 70).

15. An apparatus as defined by claim 13, in which said electric lines (20, 85) are embodied at least in part as strip-like contact rails, and said strip like contact rails (20, 85) are provided, in the vicinity of the plugs (9), with said electrically conductive elements (37) embodied in the form of flat plugs which engage said electrical contacts of the fuel injection valves that protrude into them.

16. An apparatus as defined by claim 14, in which said electric lines (20, 85) are embodied at least in part as strip-like contact rails, and said strip like contact rails (20, 85) are provided, in the vicinity of the plugs (9), with said electrically conductive elements (37) embodied in the form of flat plugs which engage said electrical contacts of the fuel injection valves that protrude into them.

17. An apparatus as defined by claim 13, in which said connection strip (46, 70) exerts a force upon the fuel injection valve (1) for axially fixing the fuel injection valve (1) in place.

18. An apparatus as defined by claim 14, in which said connection strip (46, 70) exerts a force upon the fuel injection valve (1) for axially fixing the fuel injection valve (1) in place.

19. An apparatus as defined by claim 1, in which a connection plug (21) is disposed on the connection strip (14, 46, 70) for connection to said electrically conductive elements (37) of the plugs (9).

20. An apparatus as defined by claim 1, in which said connection strip (70) is made from plastic and includes raised hoods (71) spaced apart from one another, each of said raised hoods have a blind-bore-like plug opening (72), into each of which an insert body (88) is inserted, by means of which said electrically conductive elements (37) are retained.

21. An apparatus as defined by claim 20, in which said electrically conductive elements (37) are electrically conductively connected in the plugs (9) with electric lines (85) guided in said connection strip (70), and said electric lines in the connection strip (70) are embodied as strip-like contact rails.

22. An apparatus as defined by claim 21, in which said electrically conductive elements (37) are embodied as flat plugs (37).

23. An apparatus as defined by claim 21, in which each strip-like contact rail (85) is bent in a meandering pattern out of its strip plane, forming hoops (86), and each hoop (86) protrudes into one plug opening (72), and each hoop (86) extends between the wall of the insert body (88) and the wall of the plug opening (72).

24. An apparatus as defined by claim 20, in which said connection strip (70) can be fastened to the engine and in this process exerts a force upon each fuel injection valve (1) for a axial fixation of the fuel injection valve (1).

25. An apparatus as defined by claim 20, in which a connection plug (21) is disposed on the connection strip (70) and connected via electric lines (85) with said electrically conductive elements (37) of the plugs (9).

* * * * *